US007073366B2

(12) United States Patent
Hruschak et al.

(10) Patent No.: US 7,073,366 B2
(45) Date of Patent: Jul. 11, 2006

(54) METHOD AND APPARATUS TO REDUCE THE WIDTH OF A SLOT OR OPENING IN A PIPE, TUBE OR OTHER OBJECT

(75) Inventors: Lawrence Alexander Hruschak, Ft. Saskatchewan (CA); Terry James McLean, Sherwood Park (CA); Richard Todd Ariss, Spruce Grove (CA)

(73) Assignee: Reservior Management (Barbados) Inc. (BB)

( * ) Notice: Subject to any disclaimer, the term of this patent is extended or adjusted under 35 U.S.C. 154(b) by 156 days.

(21) Appl. No.: 10/941,838

(22) Filed: Sep. 16, 2004

(65) Prior Publication Data

US 2006/0053861 A1 Mar. 16, 2006

(51) Int. Cl.
*B21D 3/02* (2006.01)

(52) U.S. Cl. ..... 72/370.27; 72/7.1; 72/7.4; 72/12.8; 72/95

(58) Field of Classification Search ..... 72/7.6, 72/8.1, 8.2, 14.8, 14.9, 15, 15.1, 15.2, 15.3, 72/12.7, 12.8, 370.27, 7.1, 7.4, 8.3, 11.1, 72/77, 78, 95, 100, 121; 29/896.61, 896.62; 356/365; 348/135, 137, 139
See application file for complete search history.

(56) References Cited

U.S. PATENT DOCUMENTS

| | | | |
|---|---|---|---|
| 965,855 | A | 8/1910 | Baur |
| 1,027,917 | A | 5/1912 | Smith |
| 1,028,065 | A | 5/1912 | Smith |
| 1,028,066 | A | 5/1912 | Smith |
| 1,055,675 | A | 3/1913 | Smith |
| 1,207,808 | A | 12/1916 | Steps |
| 1,207,809 | A | 12/1916 | Steps |
| 1,271,787 | A | 7/1918 | Smith |
| 1,566,624 | A | 12/1925 | Smith |
| 1,579,846 | A | 4/1926 | Steps |
| 1,652,208 | A | 12/1927 | McEvoy |
| 1,654,160 | A | 12/1927 | Coberly |
| 1,654,618 | A | 1/1928 | Steps |
| 1,685,287 | A | 9/1928 | McEvoy |
| 1,782,518 | A | 11/1930 | Steps |

(Continued)

FOREIGN PATENT DOCUMENTS

| | | |
|---|---|---|
| CA | 2183032 | 2/1998 |

(Continued)

OTHER PUBLICATIONS

Combined Search and Examination Report dated Sep. 28, 2005.

(Continued)

*Primary Examiner*—Dmitry Suhol
(74) *Attorney, Agent, or Firm*—Merek, Blackmon & Voorhees, LLC

(57) ABSTRACT

A method to reduce the width of slots or openings in a pipe. The method involve determining the position of the slots relative to the surface of the pipe and determining the width of the slots. A signal is generated corresponding to the determined width and relative position of the slots and the signal is directed to a controller. The controller compares the determined width of the slots with a pre-determined value and identifies slots having widths greater than the pre-determined value. The exterior surface of the pipe adjacent to the slots having determined widths greater than the pre-determined value is treated through causing one or more compression tools to be moved to selectively contact the exterior surface of the pipe adjacent to the identified slots so as to selectively reduce the width of the slots.

26 Claims, 6 Drawing Sheets

U.S. PATENT DOCUMENTS

| | | | | |
|---|---|---|---|---|
| 1,868,900 | A | 7/1932 | Hayes | |
| 2,111,680 | A | 3/1938 | Tow | |
| 2,306,945 | A | 12/1942 | Hebron | |
| 2,358,873 | A | 9/1944 | Moss | |
| 3,009,177 | A | 11/1961 | Carusi | |
| 3,327,512 | A | 6/1967 | Novak | |
| 3,520,418 | A | 7/1970 | Guinard | |
| 4,179,911 | A | 12/1979 | Saier | |
| 4,932,112 | A | 6/1990 | Tikkanen | |
| 6,112,570 | A | 9/2000 | Hruschak | |
| 6,898,957 | B1 * | 5/2005 | Slack | 72/122 |
| 2003/0193571 | A1 * | 10/2003 | Schultz et al. | 348/207.99 |
| 2004/0016278 | A1 | 1/2004 | Douman et al. | |
| 2004/0035169 | A1 | 2/2004 | Slack | |
| 2004/0244449 | A1 | 12/2004 | Hruschak et al. | |

FOREIGN PATENT DOCUMENTS

| | | |
|---|---|---|
| CA | 2324730 | 4/2002 |
| CA | 2464631 | 10/2004 |
| DE | 3213464 | 10/1983 |
| JP | 54-4386 | 4/1979 |
| WO | WO 9806535 A1 * | 2/1998 |
| WO | WO 02/34423 | 5/2002 |

OTHER PUBLICATIONS

Combined Search and Examination Report dated Jul. 21, 2005.

Canadian Patent Application Ser. No. 2,188,743, published Dec. 21, 1996.

Canadian Patent Application Ser. No. 2,299,092, published May 15, 2000.

European Patent Application Ser. No. 0297552, published Jan. 4, 1989.

* cited by examiner

METHOD AND APPARATUS TO REDUCE THE WIDTH OF A SLOT OR OPENING IN A PIPE, TUBE OR OTHER OBJECT

FIELD OF THE INVENTION

This invention relates to a method and to an apparatus to reduce the width of a slot or opening in a pipe, tube or other object, and in one aspect to a method and an apparatus to reduce the width of slots in tubular liners for well bore holes.

BACKGROUND OF THE INVENTION

Slotted metal pipes, or tubulars as they are often known, have been used for a considerable length of time in oil, gas and water wells as a means to limit the amount of sand or debris allowed to enter the tubular as oil, gas or water is drawn in from surrounding underground formations. The slotted tubulars effectively act as a liner and screening mechanism to permit the desired fluid to be drawn into the tubular for extraction while excluding sand, rock and other particles. Tubular liners must have slots that are sufficiently small in width to prevent particulate matter from entering the pipe, while maintaining sufficient structural integrity to withstand pressures to which they may be subjected in underground environments, particularly in wells having horizontal components.

The difficulty encountered with slotted tubulars is not so much in their use but in their method of manufacturing. The particular underground formation within which the tubular is to be deployed will for the most part dictate a maximum slot width that will be acceptable. In oil and gas well applications, it is often the case that the oil or gas being targeted is located in formations comprised of fine sand particles. In such situations it is not unusual to require a slot width in the tubular of 0.010 of an inch, or less. Unfortunately, conventional manufacturing equipment is rarely capable of cutting slots in tubulars effectively having a width less than 0.015 inches. As a result, manufacturers commonly subject slotted tubulars to a secondary seaming process where rollers are used to apply pressure to the tubular in the vicinity of the slot, having the result of narrowing the slot width at the exterior surface and forming a slot with a keystone, parabolic, or similar shaped profile.

A variety of different seaming methods have been proposed by others as a means to reduce the width of slots formed in tubulars through conventional mechanical methods. Such methods include those described under U.S. Pat. No. 6,112,570, dated Sep. 5, 2000; Canadian patent 2,183,032, dated Jul. 17, 2001; and, Canadian patent 2,324,730, dated Aug. 12, 2003.

Although the seaming methods that have been used by others have been generally successful, they also suffer from a number of inherent limitations. First, the alignment of seaming equipment with the slots or openings has proven to be difficult and often requires considerable operator effort and skill. To reduce the need for precise alignment of the seaming equipment with the slots or openings some have suggested passing the seaming equipment or rollers over the entire surface of the product in a helical pattern. While doing so may to a large degree alleviate alignment issues, it also significantly slows down the seaming process since the entire exterior surface of the product must be treated. Currently available methods also provide no mechanism for continuously checking the degree to which the width of the slots or openings have been reduced, or to accurately track instances where treated slots or openings do not meet specifications. Under existing methods, and with currently available equipment, the treated products are typically inspected manually and then manually sent back to the seaming process if it is determined that their slots are not within specified tolerances.

SUMMARY OF THE INVENTION

The invention therefore provides a method and an apparatus to reduce the width of a slot or opening in a pipe, tube or other object that facilitates in the alignment of seaming equipment with the slots or openings in the pipe or object, alleviates the need to completely treat the exterior surface of the product to reduce slot width, and that analyzes and tracks instances where treated slots or openings do not meet specification so that such slots or openings can be automatically re-treated.

Accordingly, in one of its aspects the invention provides a method to reduce the width of a slot or opening in a pipe, the pipe having an outer surface and an inner surface with one or more slots or openings extending between its outer and inner surfaces, the method comprising the steps of reducing the width of one or more of said slots through treating the exterior surface of the pipe with one or more compression tools; determining the position of said one or more slots relative to the surface of the pipe; following said treatment of the exterior surface of said pipe with said one or more compression tools determining the width of said one or more slots in said pipe; generating a signal corresponding to the determined width and relative position of said one or more slots and directing said signal to a controller; with said controller comparing the determined width of said one or more slots with a pre-determined value and identifying slots having widths greater than said pre-determined value; and, causing the exterior surface of said pipe adjacent to said one or more slots having determined widths greater than said pre-determined value to be re-treated through causing at least one of said one or more compression tools to be moved to selectively contact the exterior surface of said pipe adjacent to said identified slots so as to selectively further reduce the width of said slots.

In a further aspect the invention provides a method of reducing the width of a slot or opening in a pipe, the pipe having an outer surface and an inner surface with one or more slots or openings extending therebetween, the method comprising the steps of loading the pipe into a seaming machine, said seaming machine having one or more seaming heads, said one or more seaming heads and the pipe movable relative to one another, each of said one or more seaming heads including one or more seaming rollers movable from a position where they contact the surface of said pipe to a position where they are free from contract with the surface of said pipe; using said one or more seaming rollers to treat the exterior surface of said pipe adjacent to said one or more slots through the application of a compressive force to the exterior surface of said pipe to thereby reduce the width of said slots; following said treatment of the exterior surface of said pipe with said one or more seaming rollers, determining the width of said one or more slots in said pipe and the position of said one or more slots relative to the surface of said pipe; generating a signal corresponding to the determined width and relative position of said one or more slots following said treatment of the exterior surface of the pipe and directing said signal to a controller, said controller operatively connected to said one or more seaming rollers and controlling the position of said one or more seaming rollers relative to the surface of the pipe; with said controller comparing the determined width of said one or more slots to a pre-determined value and identifying slots having a width greater than said pre-determined value; and, causing said controller to move one or more of said seaming rollers into contact with the exterior surface of said pipe adjacent to said one or more slots having determined widths greater than said pre-determined value to selectively and compressively treat the exterior surface of the pipe at locations adjacent to said slots having determined widths greater than said pre-determined value and to thereby selectively further reduce the width of said slots.

The invention also concerns an apparatus for reducing the width of a slot or opening in a pipe, the pipe having an outer surface and an inner surface with one or more slots or openings extending therebetween, the apparatus comprising one or more compression tools independently movable from a position where they are free from contact with the surface of said pipe to a position where they contact the pipe's exterior surface and apply a compressive force thereto, when compressed against the exterior surface of said pipe adjacent to one or more of said slots said one or more compression tools reducing the width of said one or more slots; at least one slot measurement device, when activated said slot measurement device determining both the width and the relative position of one or more of said slots following the reduction of the width of said one or more slots, said slot measurement device further generating a signal corresponding to the determined width and relative position of said one or more slots; a controller, said controller receiving said generated signal and comparing the determined width of said one or more slots with a pre-determined value to identify slots having widths greater than said pre-determined value; and, means to cause one or more of said compression tools to be moved to selectively contact the surface of said pipe adjacent to slots having determined widths greater than said pre-determined value to selectively and further reduce the width of said slots.

In addition, the invention also concerns a method to reduce the width of a slot or opening in a pipe, the pipe having an outer surface and an inner surface with one or more slots or openings extending between its outer and inner surfaces, the method comprising the steps of determining the position of said one or more slots relative to the surface of the pipe; determining the width of said one or more slots in said pipe; generating a signal corresponding to the determined width and relative position of said one or more slots and directing said signal to a controller; with said controller comparing the determined width of said one or more slots with a pre-determined value and identifying slots having widths greater than said pre-determined value; and, with said controller causing the exterior surface of said pipe adjacent to said one or more slots having determined widths greater than said pre-determined value to be treated through causing one or more compression tools to be moved to selectively contact the exterior surface of said pipe adjacent to said identified slots so as to selectively reduce the width of said slots.

Further aspects and advantages of the invention will become apparent from the following description taken together with the accompanying drawings.

BRIEF DESCRIPTION OF THE DRAWINGS

For a better understanding of the present invention, and to show more clearly how it may be carried into effect, reference will now be made, by way of example, to the accompanying drawings which show the preferred embodiments of the present invention in which.

DESCRIPTION OF THE PREFERRED EMBODIMENT

Figure 1:
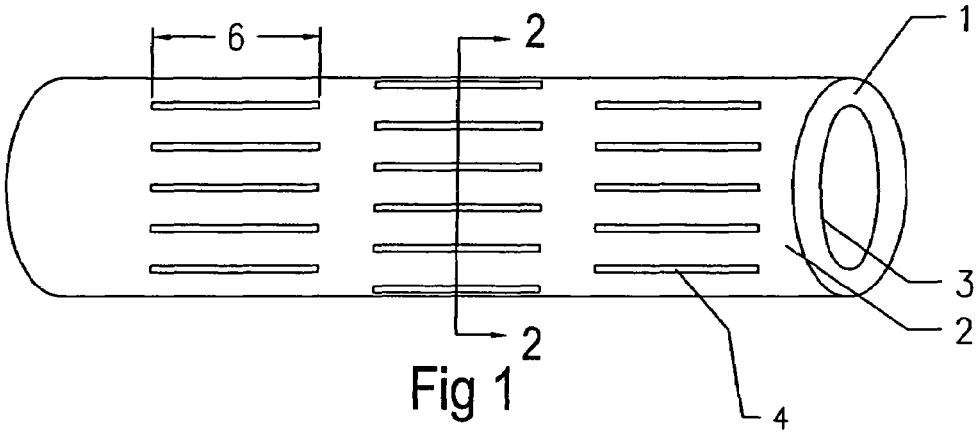
FIG. 1 is a side elevational view of a tubular element having slots formed in its exterior surface through conventional methods.

The present invention may be embodied in a number of different forms. However, the specification and drawings that follow describe and disclose only some of the specific forms of the invention and are not intended to limit the scope of the invention as defined in the claims that follow.

It should be noted that the invention described herein may be practiced in association with a wide variety of different types, shapes and sizes of objects or products having slots, holes or openings within their outer surfaces. For illustration purposes the specific embodiments of the invention that are described below concern the use of the invention in connection with a slotted pipe or tubular member. Accordingly, pursuant to one of the preferred embodiments of the invention there is provided a pipe, tube, or tubular element 1 having an outer surface 2 and an inner surface 3 (see FIG. 1). Spaced about the outer surface of tubular member 1 is a series of slots or openings 4, having a width 5 and a length 6, that extend through the pipe's wall (see FIGS. 1 and 2). Typically slots 4 will be spaced about the surface of tubular member 1 in general alignment with the longitudinal axis of the tubular member, and in a repeating pattern. However, it will be appreciated by those skilled in the art that the method and apparatus described herein may be equally applied to tubular members having slots of different orientations positioned about the surface of the tubular element. The invention is also not limited to tubular members of any particular length, and may be used on relatively short lengths of pipe, elongated tubulars, or rolls of continuous tubing. It should also be appreciated that the diameter of the tubulars may vary depending upon their end use. Where the tubulars are to be used as liners in oil, gas, or water wells, they would typically have lengths ranging from approximately 20 to approximately 45 feet, and diameters from 2 to 12¾ inches.

The manner in which slots 4 are cut or formed within tubular member 1 is, for the most part, of minor consequence to the current method and apparatus for reducing slot width. Most commonly the slots will be created through the use of a mechanical cutting tool or milling machine, although more sophisticated equipment, including lasers and water jet equipment, could also be used. Regardless of how the slots are formed, the basis for the invention is a requirement that the width of the slots be reduced to less than can be currently achieved, either technically or economically, through the use of conventional cutting, milling or slotting equipment. Once the tubular members have been slotted they may then be subjected to the apparatus and process described herein in order to reduce the width of their slots to an acceptable and desired range.

Figure 3:
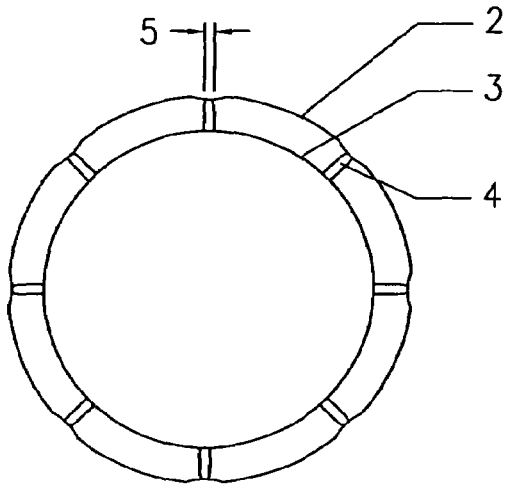
FIG. 3 is view similar to FIG. 2 wherein the slots of the tubular element have been treated such that their width has been reduced.
Figure 4:
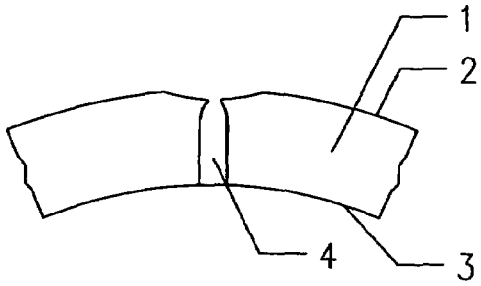
FIG. 4 is an enlarged detailed view of one of the slots of FIG. 3.
Figure 5:
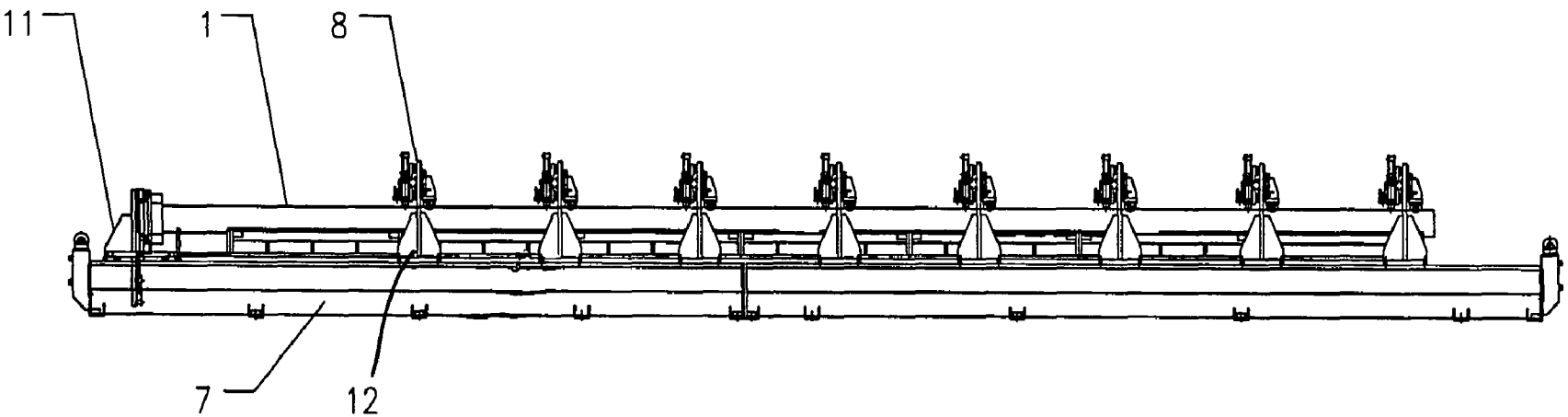
FIG. 5 is a side elevational view of a portion of a seaming machine for reducing the width of a slot in a tubular element pursuant to one of the preferred embodiments of the present invention.

The first step under the method of the present invention is to treat the exterior surface of pipe or tubular member 1 with one or more compression tools in order to reduce the width of slots 4. While a variety of different types of mechanical equipment and different methods may be used to reduce the width of the slots, in a preferred embodiment of the invention the treatment of the exterior surface of the pipe is carried out with the assistance of a seaming machine 7. With reference to FIG. 5, seaming machine 7 will in most instances have many of the same features as are currently available on similar devices, and may include one or more seaming heads 8 having mounted thereon one or more compression tools 9. Typically the compression tools will include a seaming roller 10. As is known in the art, sweeping a roller across the surface of a pipe, while at the same time applying a compressive force to the roller that is transferred to the pipe's surface, can cause the longitudinal peripheral edges of slots 4 to be deformed, resulting in a partial closing or a reduction of the width of the slots. Provided that the pressure applied by the seaming rollers exceeds the yield strength of the material from which the pipe is formed, there will be a deformation of the material along the sides of the slots, causing a portion of the material to "flow" under plastic deformation into the slots thereby reducing their widths (See FIGS. 3 and 4). Of course the amount and the degree by which the width of an individual slot is reduced will be the function of a variety of different factors; including, the amount of compressive force applied through seaming rollers 10, the material composition of the pipe, the speed at which the rollers are passed over the surface of the pipe, the alignment or misalignment of the rollers with the longitudinal axis of the slots, the temperature of the pipe during the treatment process, etc. Examples of currently available methods and devices that may used to reduce the width of a slot in a pipe may be found by reference to U.S. Pat. No. 6,112,570, dated Sep. 5, 2002; Canadian patent 2,324,730, dated Aug. 12, 2003 and Canadian patent 2,183,032, dated Jul. 17, 2001.

With reference to FIG. 5, there is shown a relatively common form of seaming machine 7 that has been modified in order to perform the method of the present invention. Here, seaming machine 7 includes a head stock assembly 11, one or more pipe carriage assemblies 12 and, as indicated previously, one or more seaming heads 8. The primary purpose of the head stock assembly is to first feed the slotted tubular member into the seaming machine, and then to secondly rotate the tubular during the various stages of the seaming or treatment process. Although not specifically shown in FIG. 5, head stock assembly 11 would typically include a series of linear rollers or bearings to facilitate the movement or loading of the tubular into the seaming machine. The head stock will also include a chuck that may be engaged about the exterior surface of the tubular to serve as both a means to hold the tubular and to impart rotational movement thereto. Typically one or more electric or hydraulic motors would be utilized to load the and rotate the tubular.

Figure 6:
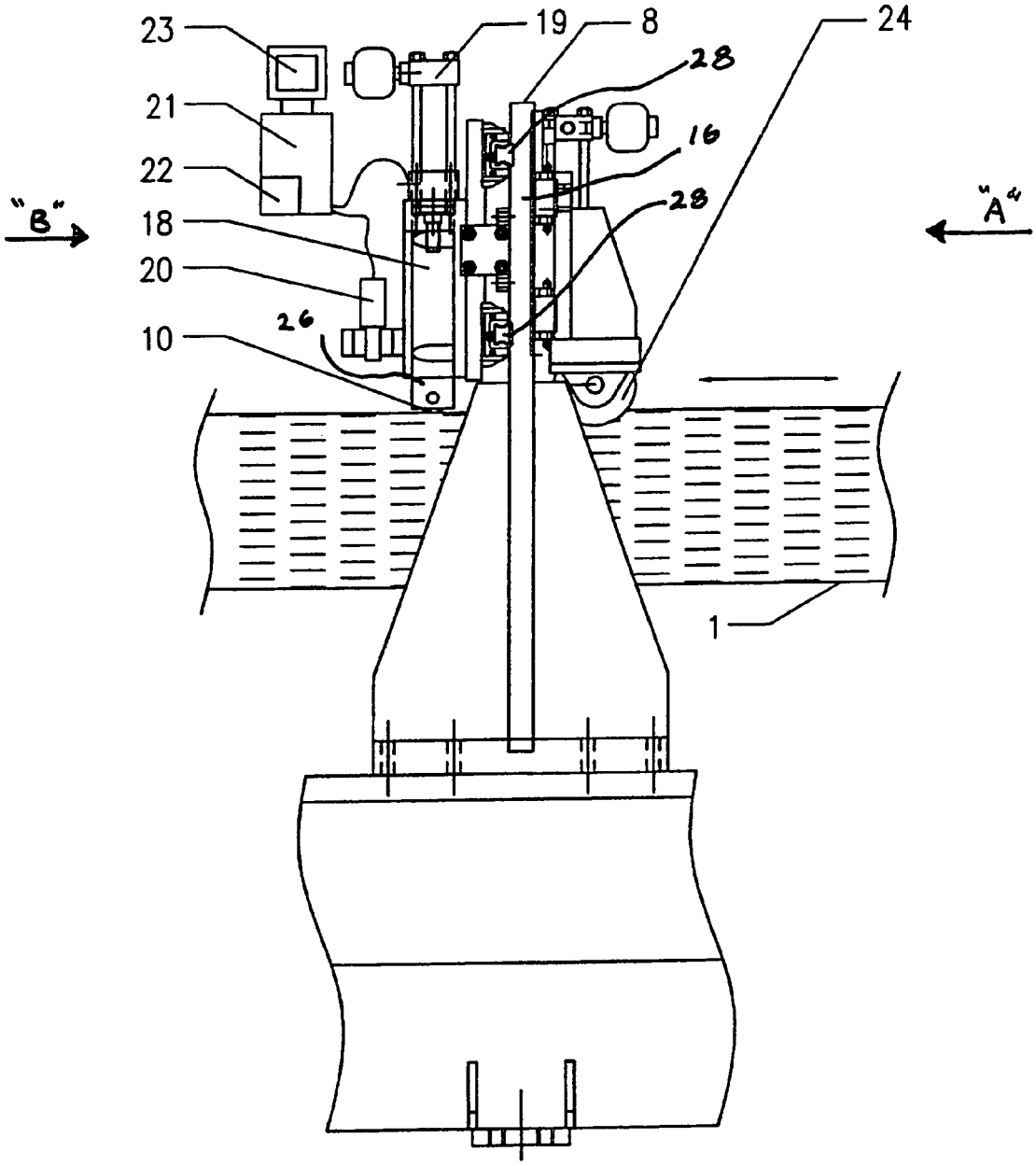
FIG. 6 is a detailed side elevational view of one of the seaming heads of the apparatus shown in FIG. 5.
Figure 7:
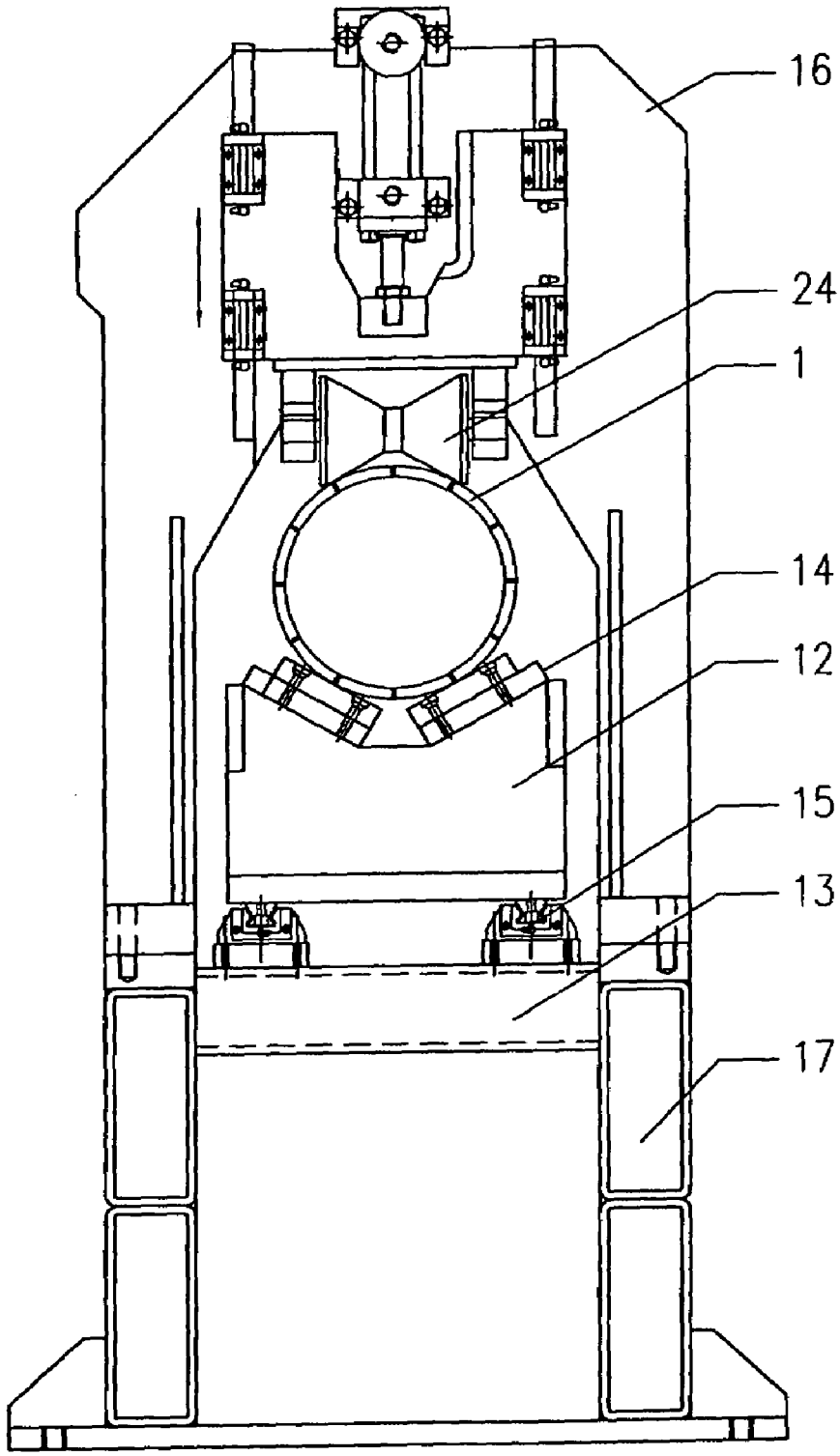
FIG. 7 is an end view of the seaming head of FIG. 6 as viewed from direction "A" in FIG. 6.
Figure 8:
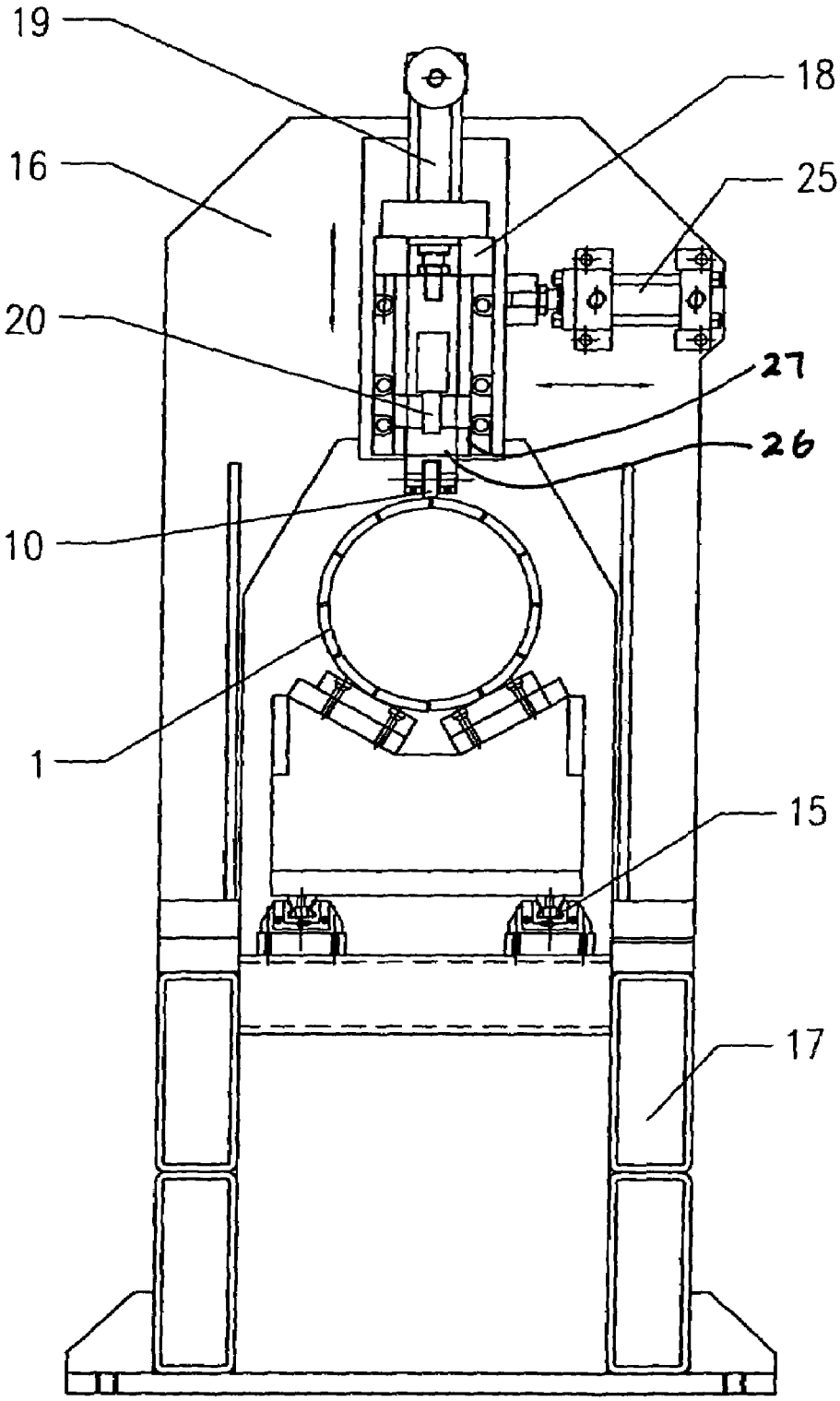
FIG. 8 is an end view of the seaming head of FIG. 6 as viewed from direction "B" in FIG. 6; and, FIG. 9 is a detailed view of the seaming roller shown in FIG. 8.

When the pipe or tubular is loaded into the seaming machine, one end will be held by head stock assembly 11 with the remainder of the tubular supported by one or more carriage assemblies 12. The carriage assembly serves the general purpose of supporting the pipe in the desired vertical and horizontal planes. As is shown in FIGS. 6, 7 and 8, carriage assembly 12 will typically be comprised of a base 13 having mounted thereon a plurality of pipe supports 14 that support and permit rotational movement of pipe or tubular member 1. Pipe supports 14 may be rollers or may be fixed structures that are formed from material that provides reduced frictional resistance to the relative movement of the carriage assembly and the pipe. The base 13 of the carriage assembly would in most instances be mounted on a pair of linear rails 15 that are aligned with the longitudinal axis of the seaming machine. Rails 15 permit the base to be moved in a back and forth manner along the length of the machine while the seaming heads remain in a fixed position relative to the machine's frame 17. Linear movement of the pipe and the carriage assemblies may be accomplished through the use of a variety of different means or devices (not specifically shown in the attached drawings), including tempo sonic hydraulic cylinders, pneumatic cylinders, ball screw drives, and electric or hydraulic drive systems (including servo drives).

It will be appreciated that relative longitudinal movement between the pipe and the seaming heads is required but that such relative movement may be accomplished in more than more manner. Accordingly, in an alternate embodiment of the seaming machine to that shown in the attached drawings, the pipe and the carriage assemblies may be fixed in position and the seaming heads may be moved in a back and forth manner along the length of the pipe.

With reference once again to FIGS. 6, 7 and 8, it will be noted that each of the seaming heads includes a frame assembly 16 secured to frame 17 of seaming machine 7. The seaming head frame assembly encompasses the pipe and the carriage assemblies such that the carriage assemblies and the tubular member may travel longitudinally therethrough. One or more seaming rollers 10 are positioned on a roller holder 26 that is slidably received within a guided channel 27 on a roller frame 18. Roller frame 18 is itself slidably received on one or more generally horizontal rails 28 positioned on frame assembly 16. Roller holder 26 is is movable in a generally vertical direction within guided channel 27 through the operation of one or more cylinders 19. Frame 18 is movable in a horizontal direction along rails 28 through the operation of one or more horizontal alignment cylinders 25. Horizontal alignment cylinders 25 permit the positioning of the seaming rollers to be adjusted where necessary in order to ensure proper alignment of the rollers with the slots. Since in most instances the roller's path will be approximately ⅛ inch wide, proper alignment with the slots is important when utilizing a seaming machine of the type shown in FIGS. 6 through 8.

Figure 9:
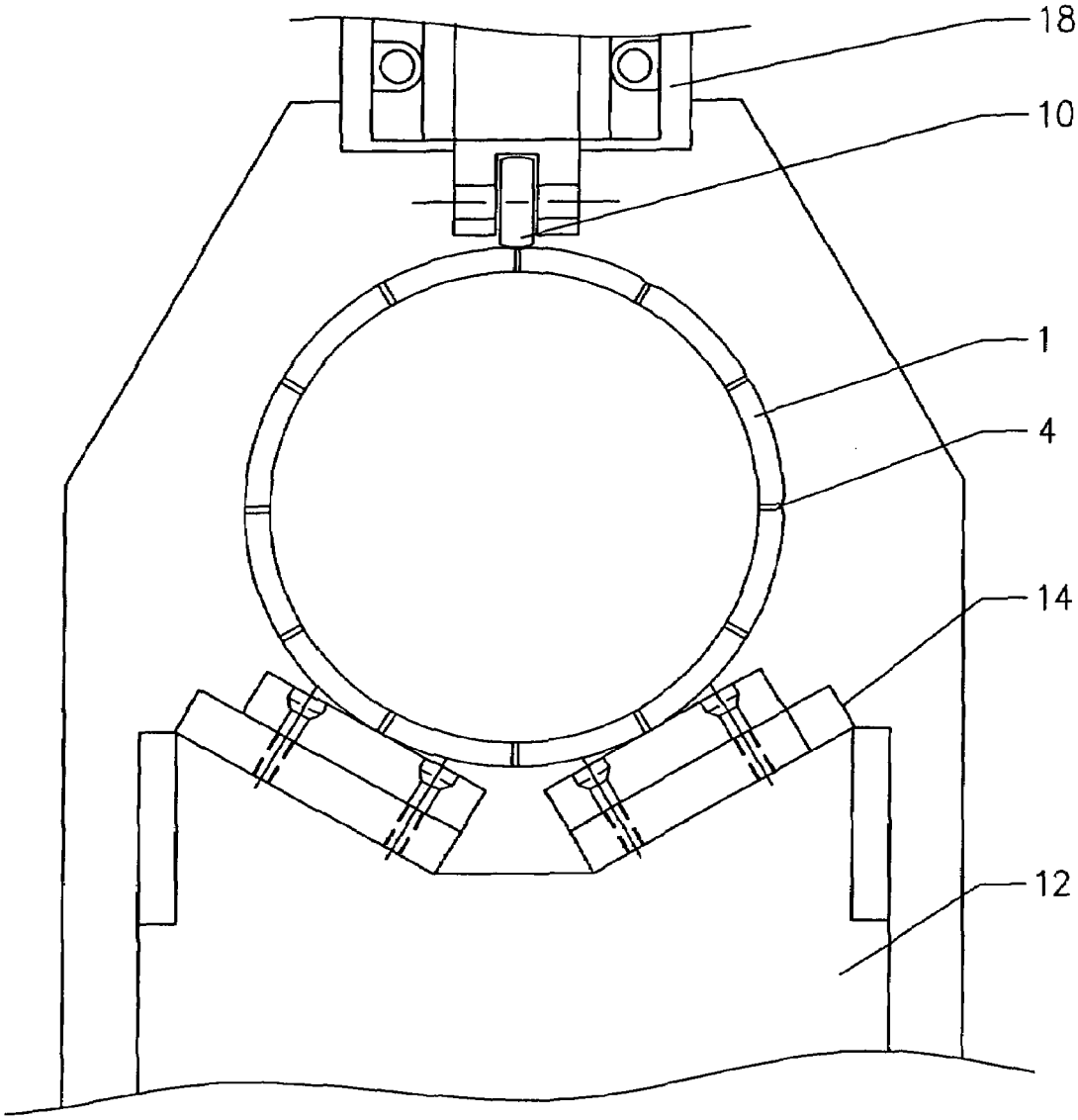

Cylinders 19 permit seaming rollers 10 to be moved from a position where they are free from contact with the surface of pipe or tubular member 1 to a position where they contact the pipe's exterior surface and apply a compressive force thereto. Through compressing rollers 10 against the surface of the pipe, and by moving the pipe and the carriage assemblies past the seaming heads (or by moving the seaming heads along the length of the pipe), the compressive force applied to the pipe by the seaming rollers will have a tendency to reduce the width of individual slots about which the rollers are positioned. As indicated previously, the amount by which the width of the slots will be reduced is a function of a variety of factors including the speed at which the pipe is moved past the rollers (or vice versa) and the compressive force applied by the seaming rollers. The amount of compressive force applied by the seaming rollers can be adjusted as necessary through operation of cylinders 19. An enlarged detailed view showing the contact between the seaming roller and the surface of pipe or tubular element 1 is provided in FIG. 9.

As shown in FIG. 7, seaming head frame assembly 16 also preferably includes a guide or clamping roller 24 mounted on the opposite side of the seaming head from the seaming roller. Guide or clamping roller 24 serves the function of helping to maintain the pipe or tubular element in position on the carriage assemblies 12. Roller 24 also helps to accommodate slight bends in the pipe by forcing the pipe into alignment with the seaming roller.

As indicated, a number of discreet and independently controllable seaming heads 8 may be positioned along the length of seaming machine 7. In the embodiment of the apparatus shown in FIG. 5 eight such heads are incorporated within the seaming machine, however, more or less than eight heads may be used depending upon the particular application at hand. Generally each of the seaming heads will be identical in structure, will perform the same function, and will be independently controllable. The amount of compressive force applied to the pipe's exterior surface can be varied from seaming head to seaming head, as desired. In addition, and as described in more detail below, in some instances the seaming rollers of specific heads may be forced into contact with the surface of the pipe to reduce the width of particular slots while the rollers of other heads may at the same time be retracted such that they do not contact the pipe's exterior surface.

Figure 2:
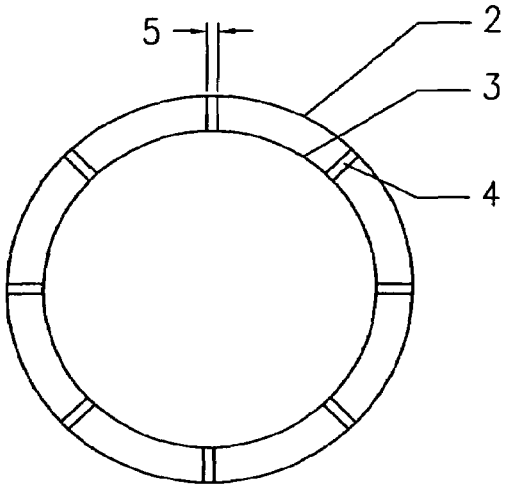
FIG. 2 is a sectional view taken along the line 2—2 of FIG. 1.

For the most part, the slots that are formed in pipes or tubular members used for wellbore liners or similar purposes, are of a uniform length and arranged in rows that are generally parallel to the longitudinal axis of the pipe (see FIG. 1). A variety of different methods of moving or sweeping seaming rollers over the exterior surface of such a pipe or tubular member in order to reduce the width of the slots is described in the prior art. Such methods most commonly involve either aligning the seaming rollers with the slots and moving the pipe in a direction that maintains the alignment of the rollers with the slots, or causing the seaming roller to follow a generally helical sweeping path across the entirety of the pipe's exterior surface. In the particular embodiment of the apparatus shown in the attached drawings, the seaming rollers are first aligned with a row of slots, after which the tubular element is moved longitudinally through the seaming machine in order to reduce the width or "seam" that particular row of slots. Once the treatment of the row of slots has been completed, the seaming rollers are retracted from the surface of the pipe, the pipe is rotated or indexed until the next row of slots is aligned with the rollers, and the treatment process is repeated.

Under the present method, after the seaming rollers have engaged the pipe's exterior surface to reduce the width of slots 4, the width of the treated slots, together with the relative position of individual slots on the surface of the pipe, is determined through the use of a slot measurement device 20. The slot measurement device may be mounted directly upon seaming head frame assembly 16 or may be positioned on a separate and dedicated frame assembly. Depending upon the required level of production, there may be utilized a single slot measurement device or a plurality of such devices spaced out along the length of the machine. The slot measurement device or devices may be operated to measure the width and relative positions of one or more slots in a continuous manner as the seaming rollers are engaged against the exterior surface of the pipe, or they may be operated to measure the slots once the initial treatment processes has been completed for either one row of slots or for the entire pipe.

In the version of the preferred embodiment of the invention that is shown in FIG. 6, slot measurement devices 20 are mounted directly upon each individual seaming head to permit a continuous and substantially simultaneous measurement of the slots as they are treated (preferably immediately after treatment). In an alternate embodiment where a complete row of slots is to be measured after the row has been treated, once all of the slots in one row have been seamed the pipe carriage assembly returns the pipe to its starting position, after which it is moved longitudinally through the seaming machine to allow for the measurement of the slots in the row in question. In the further embodiment where the entire surface of the pipe is treated before any slots are measured, following the treatment of all slots the pipe is re-positioned and the slots of individual rows are measured, after which the pipe is indexed to allow for adjacent rows of slots to be measured.

In the attached drawings each seaming head 8 is fitted with its own dedicated slot measurement device 20 mounted upon seaming head frame assembly 16. Here the slot measurement device is positioned adjacent to seaming roller 10 and is configured so as to determine the width and relative location of an individual slot immediately following the treatment of that slot by the seaming roller. Slot measurement device 20 may be a camera that optically measures the width and relative position of a slot, or may be one of a number of alternate types of slot measuring devices, including a laser detection assembly. In one form of such a laser detection device a laser beam is focused upon the surface of the pipe and the percentage of the laser beam that is reflected back and received by a corresponding detector is recorded. The width of a slot may then be calculated based upon the amount of reflected light received recorded by the detector. In alternate embodiments of the invention magnetic imaging devices and/or ultrasonic equipment may be used to measure and determine the width of the slots.

Regardless of the particular form of slot measurement device that is used its operation will result in the generation of a signal corresponding to the determined width and relative position of a slot following treatment of the slot by seaming roller 10. That signal is then directed to a controller, which in the preferred embodiment is a microprocessor 21. Controller or microprocessor 21 compares the determined width of a particular slot with a pre-determined value that has been programmed into the controller and calculates whether the slot has a width that is greater than the pre-determined value. Controller or microprocessor 21 preferably includes an electronic memory 22 such that the signals corresponding to the determined width and relative positions of the slots may be stored for future use.

Where the controller or microprocessor determines that the width of a slot that has been treated remains in excess of a pre-determined value, that slot, and its relative position upon the surface of pipe or tubular member 1, is noted by the controller so that the slot may be re-treated in order to bring its width into acceptable limits. In most instances it is expected that each row of slots will be treated, and retreated if necessary, prior to indexing the pipe. In this embodiment the re-treatment of the slots may proceed in one of two general ways. First, the slots may be individually re-treated immediately after they are seamed by roller 10 and before the roller is advanced to seam a subsequent slot. Alternately, an entire row of slots can be treated and then particular slots in that row subsequently re-treated before the pipe is indexed.

Preferably the re-treatment of the slots is carried out automatically by the controller. To accomplish this the controller is operatively connected to each of the seaming heads, and in particular to cylinders 19 and 25, in order to control the position of the seaming roller relative to the surface of the pipe. The controller will also be operatively connected to the means used to move the pipe and the carriage assemblies longitudinally through the machine so that the pipe can be re-positioned to a point where slots in need of re-treatment are once again positioned below the seaming rollers. Where necessary, cylinders 25 may be operated to help with the alignment of seaming rollers with individual slots. Once the targeted slots are properly aligned with the seaming rollers, the controller causes cylinders 19 to force the seaming rollers into contact with the exterior surface of the pipe about the particular slots in question, and to apply a compressive force thereto. Longitudinal movement of the pipe and carriage assemblies at that point will then allow the seaming rollers to re-treat the targeted slots to selectively further reduce their widths. After the slots have been sufficiently treated and/or retreated the controller will cause the head stock assembly to index the pipe and the treatment process will be repeated for slots in adjacent rows.

In an alternate embodiment of the invention the entire surface of the pipe may be treated and thereafter subjected to the re-treatment process. In such an embodiment, after the surface of the pipe has been initially treated the controller will cause the head stock assembly to rotationally index the pipe in order to move a desired row of slots into alignment with the seaming roller. Once slots in that row in need of re-treatment have been sufficiently seamed, the pipe can be indexed to the next row that contains slots requiring re-treatment.

In a further embodiment of the invention, controller or microprocessor 21 may have incorporated into it programming to permit it to calculate the amount of compressive force (based in part upon the determined size of the slot opening) needed to re-treat particular slots. In such cases the controller may operate cylinders 19 so as to apply an appropriate amount of compressive force to complete the re-treatment step while reducing the likelihood of the width of the slot remaining beyond acceptable limits after re-treatment. In this manner the controller will also help to limit the possibility of over treating the slot and reducing its width to below acceptable limits.

It will, of course, be appreciated from an understanding of the invention that where a number of individual seaming heads are utilized within seaming machine 7 there will be presented the ability for controller or microprocessor 21 to simultaneously and selectively re-treat a number of different individual slots having determined widths greater than a pre-determined value. The described method and apparatus permits any one, or any combination, of individual seaming heads to be involved in any re-treatment step. That is, since each seaming head is individually controllable, and as the amount of compressive force applied by individual seaming rollers is also individually controllable, there is presented the ability to completely customize the automated re-treatment step to bring the widths of individual slots that are outside of specification into acceptable limits. Through varying the amount of compressive force applied to individual slots during the re-treatment step there is also presented the ability to create a finished product having a more consistent distribution of slot widths across its exterior surface. It should also be noted that as the re-treatment procedure advances and the seaming rollers treat slots identified as being outside of acceptable limits, the slot measurement devices will continue to operate to determine the width and relative positions of the re-treated slots so that they can be re-considered once again by the controller to determine whether they meet acceptable standards. If after re-treatment it is found that one or more of the slots are still outside of specification, the re-treatment step may be repeated once again for those particular slots that still require a width reduction. Controller or microprocessor 21 may be programmed to continue to repeat the re-treatment process until all, or a pre-determined percentage, of the slots in the pipe have widths less than or equal to the pre-determined value.

Controller or microprocessor 21 may have connected to it a digital display screen 23 to present a visual image corresponding to the determined width and relative position of the slots in pipe or tubular member 1 following the treatment of the pipe's exterior surface and/or the re-treatment of slots that are outside of specification. Display screen 23 may also be used to visually present a continuous indication of the various operational functions of the seaming machine, and may also present an operator with the ability to adjust operational parameters of the machine and/or manually over-ride particular functions where desired. In addition, since the widths and relative positions of individual slots in the surface of the pipe determined by slot measurement device 20 are stored in electronic memory 22, there is presented the ability to print out a hard copy of such information that may physically accompany the pipe following the completion of the treatment process. That hard copy may then act as a record that can be used to authenticate the fact that the widths of the slots in the pipe fall within particular specifications.

It will also be apparent from a thorough understanding of the invention that through the use of a slot measurement device in association with each seaming head, there is presented a mechanism that may be called upon to help align the seaming rollers with individual slots prior to treatment. When the slots within the pipe are initially being treated for the first time, the slot measurement devices will assist an operator in the initial alignment of the slots with the seaming rollers. Thereafter, any re-treatment that may be necessary will also be facilitated through the use of slot measurement device 20 which may be used to re-align particular slots with individual seaming rollers.

Through the utilization of the described method and apparatus there is therefore provided a system that is capable of treating and re-treating the exterior surface of a pipe or tubular member in order to reduce the width of slots therein to a point where a defined percentage of the slot widths fall within acceptable limitations. The apparatus and method alleviate the need to physically measure slot widths following a seaming process, to physically mark or identify slots having widths beyond a pre-determined value, to re-insert the pipe or tubular back into the seaming machine, and to manually retreat individual slots. The automatic measurement, determination and re-treatment process of the present invention significantly increases the throughput of the seaming operation and provides an end product with a high degree of consistency with respect to slot width. The slot measurement devices utilized in the invention also permit the fast and accurate alignment of the seaming rollers with the slots, and further permit the automation of the alignment process.

It is to be understood that what has been described are the preferred embodiments of the invention and that it may be possible to make variations to these embodiments while staying within the broad scope of the invention. Some of these variations have been discussed while others will be readily apparent to those skilled in the art. For example, while the seaming process described above involves the longitudinal movement of seaming rollers across the surface of the pipe, as indicated previously, the seaming rollers may also be swept in a helical path over the entire surface of the pipe. It should also be noted that the treatment of the exterior surface of the pipe may be accomplished by one or more compression tools. In addition, while the preferred manner of applying pressure to the pipe's outer surface is by means of a seaming roller, other methods of compressing the pipe (including shot bombardment) may also be used. Finally, any one of a wide variety of different mechanisms may be used to load and rotate the pipe rather than by way of the head stock assembly described herein

We claim:

1. A method to reduce the width of a slot or opening in a pipe, the pipe having an outer surface and an inner surface with one or more slots or openings extending between its outer and inner surfaces, the method comprising the steps of:

(i) reducing the width of one or more of said slots through treating the exterior surface of the pipe with one or more compression tools;

(ii) determining the position of said one or more slots relative to the surface of the pipe;

(iii) following said treatment of the exterior surface of said pipe with said one or more compression tools determining the width of said one or more slots in said pipe;

(iv) generating a signal corresponding to the determined width and relative position of said one or more slots and directing said signal to a controller;

(v) with said controller comparing the determined width of said one or more slots with a pre-determined value and identifying slots having widths greater than said pre-determined value; and, (vi) causing the exterior surface of said pipe adjacent to said one or more slots having determined widths greater than said pre-determined value to be re-treated through causing at least one of said one or more compression tools to be moved to selectively contact the exterior surface of said pipe adjacent to said identified slots so as to selectively further reduce the width of said slots.

2. The method as claimed in claim 1 wherein steps (ii), (iii), (iv) and (v) are repeated until said controller determines that all or a defined percentage of said slots in said pipe have widths within a pre-determined range.

3. The method as claimed in claim 1 wherein said step of determining the width and relative position of said one or more slots is accomplished through the use of a slot measuring device.

4. The method as claimed in claim 3 wherein said slot measuring device includes one or more cameras to optically measure the width and relative position of said slots.

5. The method as claimed in claim 4 wherein said one or more cameras are further utilized to align said one or more compression tools with said slots prior to the treatment of the exterior surface of the pipe.

6. The method as claimed in claim 1 wherein said controller is a microprocessor.

7. The method as claimed in claim 6 wherein said re-treatment of the exterior surface of said pipe adjacent to said slots having widths greater than said pre-determined value is controlled by said microprocessor.

8. The method as claimed in claim 1 including the further step of storing said signals corresponding to the determined widths and relative positions of said one or more slots within an electronic memory.

9. The method as claimed in claim 1 wherein said step of treating the exterior surface of the pipe is carried out through the use of a seaming machine, said one or more compression tools comprising one or more seaming rollers mounted upon one or more seaming heads.

10. The method as claimed in claim 1 where said controller includes a digital display screen that presents a visual image corresponding to the determined width and relative position of said one or more slots in said pipe following said treatment of the pipe's exterior surface with said one or more compression tools.

11. The method as claimed in claim 1 where said step of determining the position of said one or more slots relative to the surface of the pipe is carried out prior to said step of reducing the width of said one or more slots through treating the exterior surface of the pipe with one or more compression tools.

12. The method as claimed in claim 1 where said step of determining the position of said one or more slots relative to the surface of the pipe is carried out following said step of reducing the width of said one or more slots through treating the exterior surface of the pipe with one or more compression tools.

13. A method of reducing the width of a slot or opening in a pipe, the pipe having an outer surface and an inner surface with one or more slots or openings extending therebetween, the method comprising the steps of:

(i) loading the pipe into a seaming machine, said seaming machine having one or more seaming heads, said one or more seaming heads and the pipe movable relative to one another, each of said one or more seaming heads including one or more seaming rollers movable from a position where they contact the surface of said pipe to a position where they are free from contract with the surface of said pipe;

(ii) using said one or more seaming rollers to treat the exterior surface of said pipe adjacent to said one or more slots through the application of a compressive force to the exterior surface of said pipe to thereby reduce the width of said slots;

(iii) following said treatment of the exterior surface of said pipe with said one or more seaming rollers, determining the width of said one or more slots in said pipe and the position of said one or more slots relative to the surface of said pipe;

(iv) generating a signal corresponding to the determined width and relative position of said one or more slots following said treatment of the exterior surface of the pipe and directing said signal to a controller, said controller operatively connected to said one or more seaming rollers and controlling the position of said one or more seaming rollers relative to the surface of the pipe;

(v) with said controller comparing the determined width of said one or more slots to a pre-determined value and identifying slots having a width greater than said pre-determined value; and, (vi) causing said controller to move one or more of said seaming rollers into contact with the exterior surface of said pipe adjacent to said one or more slots having determined widths greater than said pre-determined value to selectively and compressively treat the exterior surface of the pipe at locations adjacent to said slots having determined widths greater than said pre-determined value and to thereby selectively further reduce the width of said slots.

14. The method as claimed in claim 13 wherein steps (iii) through (vi) are repeated until said controller determines that a defined percentage of said slots in said pipe have widths within a pre-determined range.

15. The method as claimed in claim 13 wherein said step of determining the width and relative position of said one or more slots is accomplished through the use of a camera operatively connected to said controller.

16. The method as claimed in claim 15 including the step of aligning said one or more seaming rollers with said one or more slots prior to said treatment step, said alignment of said one or more seaming rollers with said one or more slots accomplished with the assistance of said camera.

17. The method as claimed in claim 13 including the further step of storing said signals corresponding to the determined widths and relative positions of said one or more slots in an electronic memory.

18. An apparatus for reducing the width of a slot or opening in a pipe, the pipe having an outer surface and an inner surface with one or more slots or openings extending therebetween, the apparatus comprising:

(i) one or more compression tools independently movable from a position where they are free from contact with the surface of said pipe to a position where they contact the pipe's exterior surface and apply a compressive force thereto, when compressed against the exterior surface of said pipe adjacent to one or more of said slots said one or more compression tools reducing the width of said one or more slots;

(ii) at least one slot measurement device, when activated said slot measurement device determining both the width and the relative position of one or more of said slots following the reduction of the width of said one or more slots, said slot measurement device further generating a signal corresponding to the determined width and relative position of said one or more slots;

(iii) a controller, said controller receiving said generated signal and comparing the determined width of said one or more slots with a pre-determined value to identify slots having widths greater than said pre-determined value; and, (iv) means to cause one or more of said compression tools to be moved to selectively contact the surface of said pipe adjacent to slots having determined widths greater than said pre-determined value to selectively and further reduce the width of said slots.

19. The apparatus as claimed in claim 18 wherein said controller is a microprocessor control connected to a computer screen capable of displaying data collected in connection with the determined width and relative position of said slots in said pipe following the reduction of the width of said one or more slots.

20. The apparatus as claimed in claim 18 wherein said controller includes an electronic memory, said determined widths and relative positions of said one or more slots stored in said electronic memory.

21. The apparatus as claimed in claim 18 wherein said one or more compression tools are seaming rollers positioned on one or more seaming heads, said one or more seaming rollers independently moved through operation of said controller.

22. The apparatus as claimed in claim 18 wherein said slot measurement device includes one or more cameras to optically measure the width and relative position of said slots.

23. The apparatus as claimed in claim 18 wherein said slot measurement device includes one or more lasers, magnetic imaging devices, or ultra sonic measuring devices to measure and determine the width and relative position of said slots.

24. A method to reduce the width of a slot or opening in a pipe, the pipe having an outer surface and an inner surface with one or more slots or openings extending between its outer and inner surfaces, the method comprising the steps of:

(i) determining the position of said one or more slots relative to the surface of the pipe;

(ii) determining the width of said one or more slots in said pipe;

(iii) generating a signal corresponding to the determined width and relative position of said one or more slots and directing said signal to a controller;

(iv) with said controller comparing the determined width of said one or more slots with a predetermined value and identifying slots having widths greater than said pre-determined value; and, (v) with said controller causing the exterior surface of said pipe adjacent to said one or more slots having determined widths greater than said pre-determined value to be treated through causing one or more compression tools to be moved to selectively contact the exterior surface of said pipe adjacent to said identified slots so as to selectively reduce the width of said slots.

25. The method as claimed in claim 24 where said step of determining the position of said one or more slots relative to the surface of the pipe is carried out simultaneously with said step of determining the width of said one or more slots in said pipe.

26. The method as claimed in claim 24 where said step of determining the position of said one or more slots relative to the surface of the pipe is carried out separately from said step of determining the width of said one or more slots in said pipe.

* * * * *